US005846351A

United States Patent [19]

Masahashi et al.

[11] Patent Number: 5,846,351

[45] Date of Patent: Dec. 8, 1998

[54] TIAL-BASED INTERMETALLIC COMPOUND ALLOYS AND PROCESSES FOR PREPARING THE SAME

[75] Inventors: Naoya Masahashi; Youji Mizuhara; Munetsugu Matsuo, all of Kawasaki, Japan

[73] Assignee: Nippon Steel Corporation, Tokyo, Japan

[21] Appl. No.: 795,506

[22] Filed: Feb. 11, 1997

Related U.S. Application Data

[62] Division of Ser. No. 646,650, May 3, 1996, Pat. No. 5,648,045, which is a division of Ser. No. 289,973, Aug. 12, 1994, Pat. No. 5,518,690, which is a division of Ser. No. 907,363, Jul. 1, 1992, Pat. No. 5,370,839.

[30] Foreign Application Priority Data

Jul. 5, 1991 [JP] Japan ..... 3-165403
Jul. 5, 1991 [JP] Japan ..... 3-165404

[51] Int. Cl.[6] ..... C22F 1/18

[52] U.S. Cl. ..... 148/671; 148/670

[58] Field of Search ..... 148/669, 670, 148/671

[56] References Cited

U.S. PATENT DOCUMENTS

| | | | |
|---|---|---|---|
| 4,836,983 | 6/1989 | Huang et al. | 420/418 |
| 4,842,817 | 6/1989 | Huang et al. | 420/418 |
| 4,842,819 | 6/1989 | Huang et al. | 420/418 |
| 4,842,820 | 6/1989 | Huang et al. | 420/418 |
| 4,879,092 | 11/1989 | Huang et al. | 420/418 |
| 5,028,277 | 7/1991 | Mizoguchi et al. | 148/11.5 F |
| 5,028,491 | 7/1991 | Huang et al. | 428/614 |
| 5,080,860 | 1/1992 | Huang | 420/418 |
| 5,098,653 | 3/1992 | Huang | 420/418 |
| 5,131,959 | 7/1992 | Huang | 148/421 |
| 5,190,603 | 3/1993 | Nazmy et al. | 148/671 |
| 5,207,982 | 5/1993 | Nazmy et al. | 420/418 |
| 5,232,661 | 8/1993 | Matsuo et al. | 420/421 |

FOREIGN PATENT DOCUMENTS

| | | |
|---|---|---|
| 0 365 174 | 4/1990 | European Pat. Off. . |
| 0 405 134 | 1/1991 | European Pat. Off. . |
| 0 406 638 | 1/1991 | European Pat. Off. . |
| 58-123847 | 7/1983 | Japan . |
| 61-41740 | 2/1986 | Japan . |
| 61-213361 | 9/1986 | Japan . |
| 63-125634 | 5/1988 | Japan . |
| 63-140049 | 6/1988 | Japan . |
| 63-171862 | 7/1988 | Japan . |
| 64-42539 | 2/1989 | Japan . |
| 1-259139 | 10/1989 | Japan . |
| 1-298127 | 12/1989 | Japan . |

OTHER PUBLICATIONS

Abstract of Autumn Symposium of the Japan Institute of Metals (1989) pp. 238, ($S_7$.18), N. Maeda et al.

Abstract of Autumn Symposium of the Japan Institute of Metals (1989) pp. 245, ($S_7$.22), M. Shinki et al.

Material of 53rd Meeting of Superplasticity, Jan. 30, 1990, "High Temperature Plasticity of Intermetallic Compound TiAl" N. Maeda.

Abstract of General Lecture In Autumn Symposium of The Japan Institute of Metals, Nov. 1988, pp. 498 (576) S. Noda et al.

(List continued on next page.)

*Primary Examiner*—John Sheehan
*Attorney, Agent, or Firm*—Kenyon & Kenyon

[57] ABSTRACT

TiAl-besed intermetallic compound alloys contain chromium and consist essentially of a dual-phase microstructure of γ and β phases, with the β phase precipitating at γ grain boundaries. The β phase precipitating at γ grain boundaries is 2% to 25% by volume fraction. A process for preparing TiAl-based intermetallic compound alloys comprises the steps of preparing a molten TiAl-based intermetallic compound alloy of a desired composition, solidifying the molten alloy, homogenizing the solidified alloy by heat treatment, and thermomechanically working the homogenized alloy.

12 Claims, 2 Drawing Sheets

OTHER PUBLICATIONS

Abstract of Autumn Symposium of The Japan Institute of Metals (1990) p. 268 (235) Y. Mizuhara et al.

Abstract of Autumn Symposium of The Japan Institute of Metals (1990) p. 268 (236) N. Masahashi et al.

Abstract of The Autumn Symposium of The Japan Institute of Metals (1990) p. 269 (237) T. Hanamura et al.

CAMP–ISIJ vol. 3 (1990)–1652 (586), K. Hashimoto et al.

CAMP–ISIJ vol. 3 (1990)–1653 (587) H. Fujii et al.

"Microstructural property Relationships In Titanium Aluminides and Alloys", MM & M Society, 1991, pp. 253–262, K. Hashimoto et al.

Mat. Res. Soc. Symp. Proc., vol. 213, 1991, pp. 795–800, N. Masahashi et al.

"Z. Metallkde" Bd. 81 (1990) H.11, pp. 802–808, Wunderlich et al.

Metallurgical Transactions A, vol. 19A, Oct. 1988, pp. 2445–2455, D. Vujic et al.

TIAL-BASED INTERMETALLIC COMPOUND ALLOYS AND PROCESSES FOR PREPARING THE SAME

This is a division of application Ser. No. 08/646,650 filed May 3, 1996, now U.S. Pat. No. 5,648,045, which is a division of application Ser. No. 08/289,973 filed Aug. 12, 1994 (now U.S. Pat. No. 5,518,690) which is a division of application Ser. No. 07/907,363 filed Jul. 1, 1992 (now U.S. Pat. No. 5,370,839).

BACKGROUND OF THE INVENTION

Cross Reference to Related Application

The present application is related to applicant's copending application Ser. No. 742,846 filed Aug. 8, 1991.

1. Field of the Invention

This invention relates to titanium-aluminum-based (TiAl-based) intermetallic compound alloys and processes for preparing the same. More particularly, this invention relates to TiAl-based intermetallic compound multi-component systems with high superplastic deformability and strength, containing chromium as a third major element. The TiAl-based intermetallic compound alloys according to this invention are used for heat-resistant structural materials requiring high specific strength.

2. Description of the Prior Art

Though much expectation is entertained as a heat-resisting material, TiAl intermetallic compound alloys are difficult to work due to low ductility. This low workability, a chief obstacle to the use of TiAl, can be improved by two methods; i.e. application of appropriate working method and preparation with proper alloy component design. The low workability is generally due to the lack of ductility at room temperature. Even at higher temperatures, however, the workability of TiAl alloys remains unimproved and, therefore, rolling, forging and other conventional working processes cannot be applied directly.

Applicable working processes include near-net-shaping, a typical example of which being powder metallurgy, and modified forms of rolling, forging and other conventional working processes including sheath and isothermal rolling. Forming by high-temperature sheath rolling (at a temperature of 1373 K and a speed of 1.5 m/min.) of Co-based superalloy (S-816) (Japanese Provisional Patent Publication No. 213361 of 1986) and shaping by isothermal forging at a temperature of 800° C. (1073 K) or above and a strain rate of $10^{-1}$ $sec^{-1}$ or under (Japanese Provisional Patent Publication No. 171862 of 1988) have been reported. These processes achieve forming and shaping by taking advantage of a characteristic property of TiAl to exhibit ductility at 800° C. (1073 K) together with the strain-rate sensitivity of the mechanical properties of TiAl. Still, they are unsuitable for mass production because the temperature must be kept above 1273 K and the strain rate must be kept as low as possible for the achievement of satisfactory forming and shaping. Another shaping process reported subjects a mixed compact of titanium and aluminum to a high temperature and pressure (Japanese Provisional Patent Publication No. 140049 of 1988). While this process has an advantage over those mentioned before that not only primary shaping but also various secondary shaping can be accomplished, the use of active titanium and aluminum unavoidably entails mixing of unwanted impurities.

Several processes to improve the ductility at room temperature by the addition of elements have been also reported.

While the National Research Institute for Metals of Japan proposed the addition of manganese (Japanese Provisional Patent Publication No. 41740 of 1986) and silver (Japanese Provisional Patent Publication No. 123847 of 1983), General Electric Corporation proposed the addition of silicon (U.S. Pat. No. 4836983), tantalum (U.S. Pat. No. 4842817), chromium (U.S. Pat. No. 4842819) and boron (U.S. Pat. No. 4842820). The contents of silicon, tantalum, chromium and boron in the alloy systems proposed by General Electric Corporation are determined based on the bending deflection evaluated by the four-point bend test. The content of titanium in all of them is either equal to or higher than that of aluminum. Other examples of improved ductility at high temperatures reported include the addition of 0.005% to 0.2% by weight of boron (Japanese Provisional Patent Publication No. 125634 of 1988) and the combined addition of 0.02% to 0.3% by weight of boron and 0.2% to 5.0% by weight of silicon (Japanese Provisional Patent Publication No. 125634 of 1988). For the improvement of other properties, addition of more elements must be considered. Addition of elements to improve not only ductility but also, for example, oxidation and creep resistance necessitates extensive component adjustment. A tensile elongation of 3.0% at room temperature is considered as a measure of adequate ductility. But this level has not been achieved by any of the conventionally proposed alloys. To achieve that high level of ductility, as such, grain refinement and other microstructure control measures must be taken together with the application of properly selected working processes.

SUMMARY OF THE INVENTION

The object of this invention is to provide TiAl-based intermetallic compound alloys exhibiting superplastic deformability at plastic working temperatures and high strength at room and medium temperatures and processes for preparing such alloys.

To achieve the above object, a TiAl-based intermetallic compound alloy of this invention contains chromium and consists essentially of a dual-phase microstructure of gamma (γ) and beta (β) phases, with the β phase precipitating at γ grain boundaries. With the appropriate control of microstructure through the selection of composition and working process, this TiAl-based intermetallic compound alloy exhibits a high superplastic deformability at a temperature of 1173 K or above.

Another TiAl-based intermetallic compound alloy of this invention contains chromium and consists essentially of a dual-phase microstructure of $\alpha_2$ and γ phases transformed from an alloy consisting essentially of a dual-phase microstructure of γ and β phases, with the γ phase precipitating at γ grain boundaries. This TiAl-based intermetallic compound alloy exhibits a strength of 400 MPa or above between room temperature and 1073 K. Therefore, this alloy can be shaped to near the profile of the final product by taking advantage of its superplastic deformability, with a high strength imparted through the subsequent that treatment that takes advantage of the phase transformation.

The TiAl-based intermetallic compound alloys according to this invention consists essentially of a composition with the following atomic fraction.

$$Ti_aAl_{100-1-b}Cr_b$$

where $1 \leqq b \leqq 5$ $47.5 \leqq a \leqq 52$ $2a+b \geqq 100$

The following are additional alloy compositions within the scope of the present invention.

$TiAl_{100-a-b-c}Cr_bX_c$

X:Nb, Mo, Hf, Ta, W, V where $47.5 \leqq a \leqq 52$ $1 \leqq b \leqq 5$ $0.5 \leqq c \leqq 3$ $b \geqq c$ $2a+b+c \geqq 100$.

$Ti_aAl_{100-a-b-d}Cr_bY_d$

Y:Si, B where $47.5 \leqq a \leqq 52$ $1 \leqq b \leqq 5$ $0.1 \leqq d \leqq 2$ $2a+b+d \geqq 100$.

$Ti_aAl_{100-a-b-c-d}Cr_bX_cY_d$

X:Nb, Mo, Hf, Ta, W, V

Y:Si, B where $47.5 \leqq a \leqq 52$ $1 \leqq b \leqq 5$ $0.5 \leqq c \leqq 3$ $b \geqq c$ $0.1 \leqq d \leqq 2$ $2a+b+c+d \geqq 100$.

A process for preparing a TiAl-based intermetallic compound alloy containing chromium and consisting essentially of a dual-phase microstructure of γ and β phases, with the β phase precipitating at γ grain boundaries comprises the steps of melting a TiAl-based intermetallic compound alloy of a desired component, solidifying the molten metal, subjecting the solidified metal to a homogenizing treatment at a desired temperature for a desired time, and subjecting the homogenized metal to a thermomechanical treatment to cause β phase to precipitate at γ grain boundaries.

A process for preparing a TiAl-based intermetallic compound alloy containing chromium and consisting essentially of a dual-phase microstructure of $\alpha_2$ and γ phases comprises the steps of preparing an alloy consisting essentially of a dual-phase microstructure of γ and β phases, with the β phase precipitating at γ grain boundaries, plastically forming the dual-phase alloy into a desired shape at a superplastic temperature, and transforming the microstructure of the superplastically shaped dual-phase alloy into a dualphase alloy consisting essentially of $\alpha_2$ and γ phases by a heat treatment.

DESCRIPTION OF THE PREFERRED EMBODIMENTS

Figure 1A:
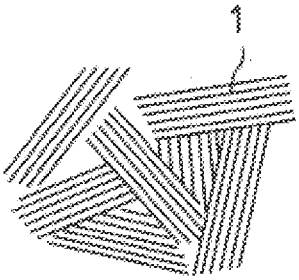
FIG. 1 schematically shows morphological changes in the microstructure. Shown at (a), (b), (c) and (d) are the microstructures of an as-cast, a homogenized, an isothermally forged, and a transformed specimen, respectively.
Figure 1B:
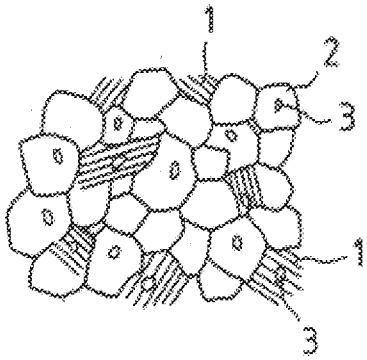
Figure 1C:
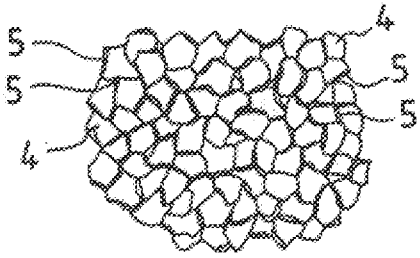
Figure 1D:
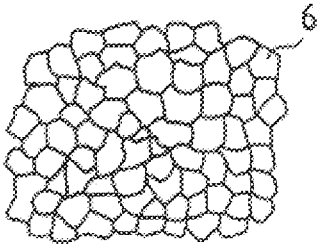

For the problems discussed before, the inventors have found the following effective solution through empirical and theoretical studies on the basic mechanical properties of multi-component TiAl-based intermetallic compound alloys, mechanical properties of materials whose microstructure is controlled by thermomechanical recrystallizing treatment, and stability of phases that have a great influence on the mechanical properties of alloys.

For the achievement of the desired microstructure control, simple grain refinement by thermomechanical recrystallization is insufficient. Instead, a dual-phase microstructure consisting essentially of γ and β phases is formed by causing β phase to precipitate at γ grain boundaries. With the induced strain released by the highly deformable β phase, the resultant alloy has a superplastic deformability without losing the intrinsic strength of TiAl. Strictly speaking, this dual-phase microstructure consisting essentially of γ and β phases is a multi-phase microstructure consisting primarily of γ and β phases, plus a slight amount of $\alpha_2$ phase that does not affect the properties of the alloy. To attain a higher strength, creep strength, and resistance to hydrogen embrittlement and oxidation, the obtained material with a superplastic deformability is transformed into a dual-phase alloy consisting of $\alpha_2$ and γ phases. The integrated thermomechanical microstructure controlling process incorporating the above steps offers an effective solution for the problems discussed before, as described below.

Precipitation of β phase at γ grain boundaries is absolutely necessary for the imparting of the above superplastic deformability. Chromium, molybdenum, vanadium, niobium, iron and manganese are known to stabilize β phase in titanium alloys. Of these elements, chromium was selected as the third element to TiAl because only chromium caused the desired precipitation in primary microstructure controlling test. To make up for the insufficient strength of the TiAlCr ternary alloy without inhibiting the precipitation of β phase at γ grain boundaries, several high melting point elements were added. In a deformability test at room temperature prior to the application of microstructure control, molybdenum, vanadium, niobium, tungsten, hafnium and tantalum proved to increase strength, enhancing, strengthening in the TiAl alloys, without impairing the room temperature compressive deformability improvement by chromium addition. Improvement in strength occurred not only at room temperature, but also at higher temperatures. Thus, molybdenum, vanadium, niobium, tungsten, hafnium and tantalum were chosen as the fourth alloying element. Even in the quaternary systems with these elements, the precipitation of β phase at γ grain boundaries occurred in essentially satisfactory manners. No problem occurred so long as the quantities of the fourth alloying element and chromium, the third alloying element, were kept within certain limits. Then, micro-alloying with a fifth element to achieve further strengthening was tested with boron and silicon. These two elements proved to remarkably improve strength between room temperature and 1073 K without impairing the forming of β phase by chromium and solid solution by the fourth alloying elements.

It is preferably to keep the alloying elements within the following limits.

Addition of chromium must be made while keeping the content of titanium higher than that of aluminum. If the fourth alloying element exceeds a certain limit, the resulting increase in the strength of the matrix impairs the superplastic deformability, even if β phase precipitates at γ grain boundaries. Therefore, the quantity of chromium must be larger than that of the fourth alloying element. Furthermore, chromium and the fourth alloying element must be added as a substitution direction for aluminum. To insure the precipitation of β phase, besides, the addition of chromium must be not less than 1% (by atomic weight, for all percentages described). Under 1%, not much enough β phase to impart the desired superplastic deformability precipitates at γ grain boundaries. Over 5%, a precipitated phase consisting primarily of titanium and chromium appears in the matrix, which pointlessly increases the density of the alloy, though superplasticity remains unimpaired.

The key consideration for the addition of the fourth alloying element is to keep its quantity below that of chromium. As have been reported, molybdenum Jan. 30, 1990. 53rd Study Meeting on Superplasticity at Osaka International Exchange Center) and titanium (Metall. Trans. A 14A (1983) 2170), in particular, permit the precipitation of β phase in the matrix. The strengthened matrix damages the β phase formed at γ grain boundaries. As such, the precipitation site of β phase must be limited to γ grain boundaries. The inventors found that the β phase precipitated in the matrix contributes to the improvement of strength, but not to the securing of deformability. Therefore, the quantity of the fourth alloying element must be always smaller than that of chromium and in the range of 0.5% to 3%. Under 0.5%, addition of the fourth alloying element does not definitely enhances solution strengthening. The upper limit is set at 3% because excess matrix strengthening is unnecessary for the securing of deformability at high temperatures through the precipitation of β phase at γ grain boundaries. Insufficient strengthening can be adequately made up for by the transformation heat treatment to be applied subsequently.

Silicon and boron are added as the fifth alloying element to increase strength at temperatures under medium temperatures. Slight addition of these elements helps solution strengthening and the precipitation hardening by a finely dispersed precipitated phase. The quantity of the fifth alloying element is determined so as not to impair the forming of β phase at γ grain boundaries and the effect of the fourth alloying element to enhance the formation of solution strengthening in the matrix. While no marked strengthening is achieved under 0.1%, the precipitated phase overstrengthens the matrix beyond 2%, as a result of which even the β phase precipitated at γ grain boundaries does not release the accumulated strain.

Then, a fine-grained dual-phase microstructure consisting essentially of γ and β phases, with the β phase precipitating at γ grain boundaries and γ phase constituting the matrix, is obtained by applying homogenizing and thermomechanical heat treatments, preferably under the following conditions.

The molten alloy specimen is subjected to a homogenizing heat treatment at a temperature between 1273 K and the solidus temperature for a period of 2 to 100 hours. This treatment removes the macrosegregation occurred in the melting process. Also, the establishment of structural equilibrium stabilizes the lamellar phase consisting of initial $\alpha_2$ phase and some β phase precipitating therein. The resulting fine-grained dual-phase microstructure consisting of γ and β phases contains a small quantity of $\alpha_2$ phase which failed to transform into β phase despite the thermomechanical heat treatment. The $\Delta_2$ phase is very slight, being not more than a few percent in terms of volume fraction, and meaningless to this invention.

The thermomechanical heat treatment must be carried out under such conditions that the initial as-cast dual-phase microstructure consisting of γ and $\alpha_2$ phases is broken to permit the recrystallization of γ phase. Conceivably, the precipitate β phase formed by thermal transformation or other heat treatment preceding the thermomechanical treatment can sufficiently withstand the deformation induced by thermomechanical treatment to cause the recrystallization of γ phase. Finally, the recrystallized γ phase is considered to change into a microstructure consisting of β phase precipitated at γ grain boundaries, with the β phase deformed in the process of grain growth serving as a barrier. Based on the above assumption derived from the empirical results, the required thermomechanical heat treatment conditions were studied. When chromium is used as the third alloying element, as revealed by the inventors, β phase is formed in $\alpha_2$ phase of the initial lamellar structure in the melting process. Therefore, thermomechanical recrystallization is not necessarily essential for the forming of β phase. Therefore, the temperature is between 1173 K and the solidus temperature, in which range γ phase is recrystallized. Under 1173 K, adequate recrystallization of γ grains and, crystallization of β phase at γ grain boundaries do not take place as a consequence. To obtain a uniform microstructure, the percentage of working was set at 60% and above. Working under this level leaves unrecrystallized regions. Then a satisfactory dual-phase microstructure consisting essentially of γ and β phases, with the β phase precipitating at γ grain boundaries, does not form, and some β phase remaining in the matrix inhibits the impartment of superplastic deformability.

When the initial strain rate is 0.5 $sec^{-1}$ or above, β phase does not precipitate sufficiently at γ grain boundaries because unrecrystallized deformed structures are formed in addition recrystallized microstructures. When the initial strain rate is lower that $5\times10^{-5}$ $sec^{-1}$, fine recrystallized γ grains grow to drastically impair the superplasticity inherent therein. The result is the loss of the superplasticity characterizing this invention and a marked drop in productivity. Under these conditions, the volume fraction of β phase at γ grain boundaries is between 2% and 25%. Under 2%, β phase is not much enough for superplastic working. Over 25%, the strength required of the TiAl-based alloys is unattainable.

Also, the thermomechanical heat treatment is performed in a nonoxidizing atmosphere and in a vacuum of 0.667 Pa ($5\times10^{-3}$ Torr) or below. In an oxidizing atmosphere or in a lower vacuum, TiAl-based intermetallic compound alloys are oxidized to impair various properties. The cooling rate is not lower than 10 K/min. With an alloy consisting essentially of γ phase and β phase precipitated at the grain boundaries thereof, to begin with, superplastic working is achieved by taking advantage of β phase. When cooled at a slower rate than 10 K/min., however, part of β phase transforms into $\alpha_2$ and γ phases to impair the excellent superplastic deformability of the alloy. In the second stage the strength of the alloy subjected to superplastic working is increased by transforming β and γ phases into $\alpha_2$ and γ phases. In this transformation heat treatment, the temperature and time are important, but the cooling rate is not significant. Considering the economy of the process, there is no need to slow down the cooling rate excessively. The object of the transformation heat treatment is achieved if the cooling rate is faster than 10 K/min. The lower temperature limit is set at 873 K to keep the β phase necessary for the realization of superplastic deformation as stable as possible because lowering the cooling rate and lower temperature limit is equivalent to the stabilization of lamellar structure on the TTT diagram. Because the lower temperature limit must be kept as high as possible, 873 K was elected as the highest possible temperature. Under this temperature, the lamellar structure becomes more stable, and reheating becomes necessary in the subsequent transformation heat treatment process to add to the complexity of the process.

The Ti-alloy capsules containing the specimens subjected to isothermal forging, hot extrusion and rolling were evacuated to 0.667 Pa ($5\times10^{-3}$ Torr) or below to keep the specimens out of contact with the atmosphere to prevent the oxidation thereof, thereby permitting the subsequent thermomechanical heat treatments to be carried out in the atmosphere. The specimens subjected isothermal forging, hot extrusion and rolling were sheathed in the Ti-alloy capsules for the benefit of process simplicity because the Ti-alloy can provide the minimum necessary protection from oxidation necessitated by the subsequent thermomechanical structure control processes.

The capsules or cases of the Ti-alloy were used because of the low reactivity at the interface of contact with the material tested and the appropriate strength ratio of specimen to Ti-alloy at the working temperature. If the strength of the tested material is much higher than that of the capsule or case, nearly hydrostatic pressure to specimens is not attained because the capsule or case bears the working strain. In the worst case, the capsule or case may break prior to microstructure controlling. In the opposite case, the working strain is consumed in the deformation of the capsule or case. Then, the load working on the specimen decreases to retard the progress of thermomechanical recrystallization. In the worst case, the capsule or case may break.

In the first stage, the microstructure having an excellent superplastic deformability prepared by the thermomechanical treatment. Then, with the transformation heat treatment in the second stage β phase is turned to disappear which is caused by taking advantage of the fact the β phase formed in the first stage is a metastable phase. This means that β phase not contributing to strength is transformed to dual-phase of $\alpha_2$ and γ phases that contributes to strength by heat treatment equilibrium. The inventors revealed that the β phase formed in the first stage readily disappears on application of appropriate heat treatment. Further studies revealed that β phase exists in a nonequilibrium state. Considering the stability of β phase, the transformation heat treatment is applied between 1173 K and the solidus temperature for a period of 2 to 24 hours. Being thermally in a metastable condition, the β phase formed in the first stage readily transforms into a dual-phase microstructure consisting of $\alpha_2$ and γ phases. Under 1173 K, transformation takes an uneconomically long time. The volume fraction of the $\alpha_2$ phase formed by the transformation heat treatment depends on the volume fraction of β phase at the initial γ grain boundaries. To cause superplastic deformation without impairing the strength of γ phase, β phase at γ grain boundaries should preferably be from 2% to 25%, as mentioned before. The volume fraction of the $\alpha_2$ phase formed by eliminating the β phase in the above range naturally becomes 5% minimum or 40% maximum depending on the quantity of the initial β phase and the conditions of the transformation heat treatment applied. If the percentage of the initial β phase is lower than 2% or the transformation heat treatment time and temperature are not long and high enough to eliminate the β phase, the percentage becomes under 5%. In this case, part ofβ phase remains unremoved, and the desired improvement in strength not attained. If the percentage of the initial β phase is higher than 25% or the transformation heat treatment time and temperature are longer and higher, the percentage of $\alpha_2$ phase exceeds 40%. These conditions are practically meaningless as no further strengthening is possible. The mechanism of strengthening depends only on the phase transformation of metastable β phase at γ grain boundaries, not on any other factors. So long as the percentage of β phase at γ grain boundaries remains within 25%, the volume fraction of the $\alpha_2$ phase formed by the phase transformation thereof necessarily does not exceed 40%.

FIG. 1 schematically shows morphological changes in the microstructure just described. FIG. 1(*a*) shows the microstructure of an as-cast specimen prepared by solidifying a molten TiAl-based intermetallic compound alloy containing chromium. The solidified structure is a coarse structure consisting of lamellar colonies 1 of γ and $\alpha_2$ phases. FIG. 1(*b*) shows the microstructure of a homogenized specimen, which consists of equiaxed grains containing some lamellar colonies 1. Islands of β phase 3 exist in the matrices of γ phase 2 and the lamellar colonies 1 (of $\alpha_2$ phase). FIG. 1 (*c*) shows the microstructure of an isothermally forged specimen, in which 1 to 5 μm wide films of β phase 5 precipitate at the boundaries of γ grains 4 which too have been refined into equiaxed grains as a result of recrystallization. FIG. 1(*d*) shows the microstructure of a thermally transformed specimen, in which γ grains 6 remain uncoarsened. The metastable βphase shown in FIG. (c) has disappeared as the result of the phase transformation into stable $\alpha_2$ and γ phases. Whether $\alpha_2$ phase forms lamellar colonies or not depends on the conditions of the transformation heat treatment.

[EXAMPLES]

Approximately 80 mm in diameter by 300 mm long ingots of TiAl-based intermetallic compound alloys were prepared from various mixtures of high-purity titanium (of 99.9 wt.% purity), aluminum (of 99.99 wt. % purity) and chromium (of 99.3 wt. % purity) melted by the plasma melting process. The ingots were homogenized in a vacuum at 1323 K for 96 hours. Table 1 shows the chemical analyzed compositions of the homogenized ingots. In addition to the components shown in Table 1, the alloys contained 0.009% to 0.018% of oxygen, 0.02% to 0.009% of nitrogen, 0.003 to 0.015% of carbon and 0.002% of iron. As a result of the homogenization, the grains making up the ingots became equiaxid. The grain size the specimen representing Example 1 of this invention was 80 μm.

TABLE 1-1

| | | Chemical Composition | | | | | | | | | |
|---|---|---|---|---|---|---|---|---|---|---|---|
| | | P1 | P2 | P3 | P4 | P5 | P6 | P7 | P8 | P9 | P10 |
| Element | Ti | 50.6 | 51.6 | 50.1 | 48.9 | 49.2 | 48.8 | 48.2 | 49.6 | 48.2 | 46.3 |
| | Al | 46.5 | 43.5 | 46.6 | 47.0 | 47.0 | 46.8 | 46.5 | 44.5 | 44.9 | 45.5 |
| | Cr | 2.90 | 4.90 | 2.80 | 2.83 | 2.85 | 2.60 | 1.90 | 3.30 | 4.62 | 2.55 |
| | Nb | | | | | 0.99 | 1.05 | | | | |
| | Mo | | | | | | | | | 2.28 | 2.12 |
| | Hf | | | | | | | 1.50 | | | |
| | Ta | | | | | | | | 2.00 | | |
| | W | | | | | | | | | | 1.40 |
| | V | | | | | | | 1.30 | | | 1.53 |
| | Si | | | 0.57 | | | 0.75 | 0.60 | | | 1.50 |
| | B | | | | 1.33 | | | | 0.60 | | |
| | Mn | | | | | | | | | | |
| Results | Tensile Elongation/% | <470 | <470 | <470 | <470 | 384 | 421 | 355 | 423 | <470 | 247 |
| | m Value | 0.49 | 0.46 | 0.41 | 0.47 | 0.42 | 0.40 | 0.36 | 0.38 | 0.48 | 0.35 |

P: Preferred Embodiment
C: Trial Alloy for Comparison

TABLE 1-2

| | | Chemical Composition | | | | | | | | | | |
|---|---|---|---|---|---|---|---|---|---|---|---|---|
| | | C1 | C2 | C3 | C4 | C5 | C6 | C7 | C8 | C9 | C10 | C11 |
| Element | Ti | 48.2 | 50.2 | 50.5 | 46.8 | 51.3 | 49.5 | 50.2 | 47.2 | 43.5 | 48.8 | 56.1 |
| | Al | 48.6 | 48.6 | 49.5 | 53.2 | 46.3 | 47.0 | 47.0 | 48.2 | 43.3 | 46.0 | 45.1 |
| | Cr | | | | | 0.5 | 0.9 | | 1.2 | 4.5 | 0.8 | 2.2 |
| | Nb | | | | | | | | | | 0.5 | 3.7 |
| | Mo | | | | | | | | 2.2 | | | |
| | Hf | | | | | 1.9 | | | | | 1.9 | |
| | Ta | | | | | | 1.6 | | | 2.5 | | |
| | W | | | | | | 1.0 | | | 3.3 | | 1.6 |
| | V | 3.20 | | | | | | | | | | 1.4 |
| | Si | | | | | | | 1.9 | 1.2 | 2.9 | | |
| | B | | | | | | | 0.9 | | | | |
| | Mn | | 1.20 | | | | | | | | 2.0 | |
| Results | Tensile Elongation/% | 176 | 101 | 116 | 69 | 215 | 128 | 115 | 167 | 85 | 90 | 118 |
| | m Value | 0.24 | 0.22 | 0.23 | 0.12 | 0.26 | 0.22 | 0.16 | 0.15 | 0.15 | 0.18 | 0.23 |

P: Preferred Embodiment
C: Trial Alloy for Comparison

Figure 2:
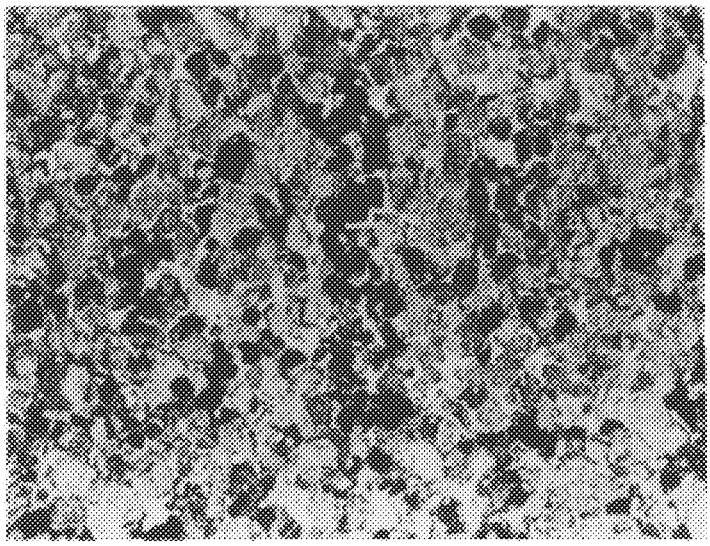
FIG. 2 is a photomicrograph showing the microstructure of an isothermally forged specimen obtained by the first preferred embodiment of this invention shown in Table 1.
Figure 3:
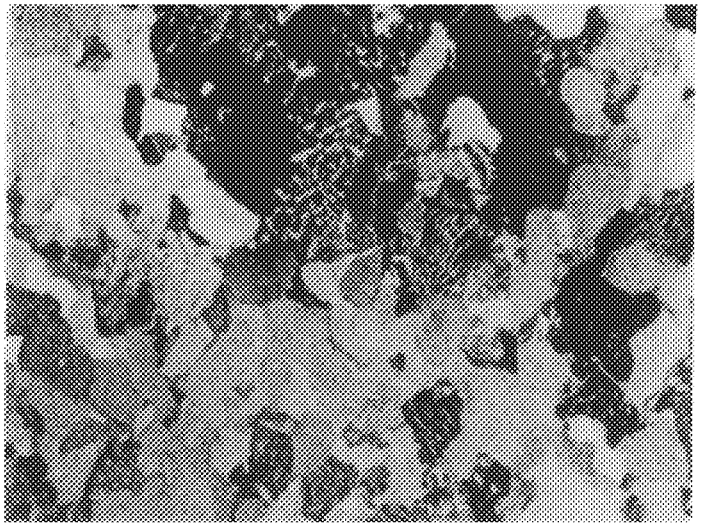
FIG. 3 is a photomicrograph showing the microstructure of an isothermally forged specimen obtained by the first trial method for comparison shown in Table 1.

The cylindrical ingots, 35 mm in diameter by 42 mm long, cut out from the above ingots by the electro-discharge process were subjected to isothermal forging. In the isothermal forging process, the specimens at 1473 K were reduced by 60% in a vacuum with an initial strain rate of $10^{-4}s^{-1}$. FIG. 2 is a microphotograph showing the structure of the isothermally forged specimen representing Example 1 of this invention. While the size of the equiaxed fine-grained γ grains averaged 20 μm, a phase not thicker than few μm precipitated at the grain boundaries. The precipitated phase at the grain boundaries was identified as β phase. FIG. 3 is a photomicrograph of the microstructure of the isothermally forged specimen representing Trial Alloy for Comparison 1. While the structure consisted of equiaxed fine grains averaging 25 μm in diameter, no precipitated phase was observed at the grain boundaries.

Tensile test specimens having a gauge section measuring 11.5 mm×3 mm×2 mm were cut out from the isothermally forged ingots by the wire cutting process. Tensile tests were made in a vacuum at different strain rates and temperatures. Each test was continued until the specimen reptured at fixed initial strain rate and temperature and a true stress-true strain curve was derived from the obtained result. Strain-rate sensitivity factor (m) and elongation were derived from the true stress-true strain curves. Table 1 shows the results obtained at a temperature of 1473 K and a true stress of 0.1.

As can be seen in Table 1, elongation of the alloys according to this invention improved remarkably at high temperatures, and the exponent m was over 0.3 which is the point where superplasticity appears. By contrast, none of the trial alloys for comparison exhibited such high plasticity as was observed in the alloys of this invention even at high temperatures. The gauge section of the specimens exhibiting superplasticity deformed uniformly without necking. Their β phase at the grain boundaries elongated along grain boundaries after tensile test high temperature. By comparison, all trial alloys for comparison necked down. Table 2 shows the relationship between the homogenizing and thermomechanical heat treatment conditions and superplastic deformability.

TABLE 2-1

| | | Homogenization | | | | Temperature | | | | Strain Rate | | | Working Ratio | | | | | | |
|---|---|---|---|---|---|---|---|---|---|---|---|---|---|---|---|---|---|---|---|
| | | C12 | C13 | C14 | P11 | C15 | C16 | P12 | P13 | C17 | C18 | C19 | C20 | C21 | C22 | C23 | P14 | P15 | P16 |
| Element | Ti | 50.8 | 50.8 | 50.8 | 50.8 | 50.8 | 50.8 | 50.8 | 50.8 | 50.8 | 50.8 | 50.8 | 50.8 | 50.8 | 50.8 | 50.8 | 50.8 | 50.8 | 50.8 |
| | Al | 46.1 | 46.1 | 46.1 | 46.1 | 46.1 | 46.1 | 46.1 | 46.1 | 46.1 | 46.1 | 46.1 | 46.1 | 46.1 | 46.1 | 46.1 | 46.1 | 46.1 | 46.1 |
| | Cr | 3.10 | 3.10 | 3.10 | 3.10 | 3.10 | 3.10 | 3.10 | 3.10 | 3.10 | 3.10 | 3.10 | 3.10 | 3.10 | 3.10 | 3.10 | 3.10 | 3.10 | 3.10 |
| Homogenization | Temperature/K | 1323 | 1173 | 1173 | 1273 | 1323 | 1323 | 1323 | 1323 | 1323 | 1323 | 1323 | 1323 | 1323 | 1323 | 1323 | 1323 | 1323 | 1323 |
| | Time/Hr | 96 | 1 | 96 | 96 | 96 | 96 | 96 | 96 | 96 | 96 | 96 | 96 | 96 | 96 | 96 | 96 | 96 | 96 |
| Thermo-mechanical Treatment | Temperature/K | | 1473 | 1473 | 1473 | 1073 | 1123 | 1273 | 1573 | 1473 | 1473 | 1473 | 1473 | 1473 | 1473 | 1473 | 1473 | 1473 | 1473 |
| | Strain Rate/$s^{-1}$ | | $10^{-4}$ | $10^{-4}$ | $10^{-4}$ | $10^{-4}$ | $10^{-4}$ | $10^{-4}$ | $10^{-4}$ | 60 | 6 | 0.6 | $10^{-4}$ | $10^{-4}$ | $10^{-4}$ | $10^{-4}$ | $10^{-4}$ | $10^{-4}$ | |
| | Working Ratio/% | | 60 | 60 | 60 | 60 | 60 | 60 | 60 | 60 | 60 | 60 | 20 | 30 | 40 | 50 | 60 | 70 | 80 |
| | Atmosphere/Torr | | Vacuum | Vacuum | Vacuum | Vacuum | Vacuum | Vacuum | Vacuum | Vacuum | Vacuum | Vacuum | Vacuum | Vacuum | Vacuum | Vacuum | Vacuum | Vacuum | Vacuum |
| | Type of Working | | Forging | Forging | Forging | Forging | Forging | Forging | Forging | Forging | Forging | Forging | Forging | Forging | Forging | Forging | Forging | Forging | Forging |
| | Cooling Rate K/min | | 10 | 10 | 10 | 10 | 10 | 10 | 10 | 10 | 10 | 10 | 10 | 10 | 10 | 10 | 10 | 10 | 10 |
| | Casing | | Not Used | Not Used | Not Used | Not Used | Not Used | Not Used | Not Used | Not Used | Not Used | Not Used | Not Used | Not Used | Not Used | Not Used | Not Used | Not Used | Not Used |
| Results | Tensile Elongation/% | 83 | 160 | 200 | 357 | 105 | 122 | 285 | 480 | 195 | 210 | 305 | 120 | 122 | 142 | 195 | <470 | <470 | <470 |
| | m Value | 0.13 | 0.18 | 0.22 | 0.39 | 0.26 | 0.28 | 0.36 | 0.49 | 0.27 | 0.29 | 0.38 | 0.20 | 0.21 | 0.25 | 0.29 | 0.49 | 0.48 | 0.46 |

P: Preferred Embodiment
C: Trial Alloy for Comparison

TABLE 2-2

| | | Atmosphere | | Type of Working | | Cooling Rate | | Casing | | | |
|---|---|---|---|---|---|---|---|---|---|---|---|
| | | C24 | P17 | P18 | P19 | C25 | C26 | P20 | C27 | C28 | C29 |
| Element | Ti | 50.8 | 50.8 | 50.8 | 50.8 | 50.8 | 50.8 | 50.8 | 50.8 | 50.8 | 50.8 |
| | Al | 46.1 | 46.1 | 46.1 | 46.1 | 46.1 | 46.1 | 46.1 | 46.1 | 46.1 | 46.1 |
| | Cr | 3.10 | 3.10 | 3.10 | 3.10 | 3.10 | 3.10 | 3.10 | 3.10 | 3.10 | 3.10 |
| Homogenization | Temperature/K | 1323 | 1323 | 1323 | 1323 | 1323 | 1323 | 1323 | 1323 | 1323 | 1323 |
| | Time/Hr | 96 | 96 | 96 | 96 | 96 | 96 | 96 | 96 | 96 | 96 |
| Thermo-mechanical Treatment | Temperature/K | 1473 | 1473 | 1473 | 1473 | 1473 | 1473 | 1473 | 1473 | 1473 | 1473 |
| | Strain Rate/$s^{-1}$ | $10^{-4}$ | $10^{-4}$ | $10^{-4}$ | $10^{-4}$ | $10^{-4}$ | $10^{-4}$ | $10^{-4}$ | $10^{-4}$ | $10^{-4}$ | $10^{-4}$ |
| | Working Ratio/% | 60 | 60 | 60 | 60 | 60 | 60 | 60 | 60 | 60 | 60 |
| | Atmosphere/Torr | Atmosphere | Argon | Vacuum | Vacuum | Vacuum | Vacuum | Vacuum | Vacuum | Vacuum | Vacuum |
| | Type of Working | Forging | Forging | Rolling | Hot Extrusion | Forging | Forging | Forging | Forging | Forging | Forging |
| | Cooling Rate K/min | 10 | 10 | 10 | 10 | 1 | 2 | 10 | 10 | 10 | 10 |
| | Casing | Not Used | Not Used | Not Used | Not Used | Not Used | Not Used | Ti Alloy | Co Alloy | Ni Alloy | Fe Alloy |
| Results | Tensile Elongation/% | 64 | 382 | 280 | 263 | 205 | 244 | 294 | 85 | 103 | 101 |
| | m Value | 0.14 | 0.38 | 0.36 | 0.32 | 0.27 | 0.29 | 0.37 | 0.15 | 0.13 | 0.16 |

P: Preferred Embodiment
C: Trial Alloy for Comparison

As shown in Table 2, the value of exponent m was higher than 0.3, which is the point at which superplasticity appears, for all alloys according to this invention, and under 0.3 for all trial materials for comparison.

Figure 4:
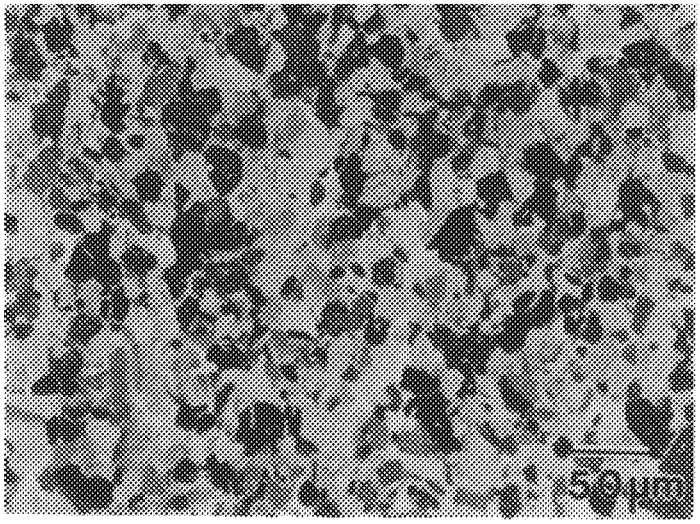
FIG. 4 is a photomicrograph showing the microstructure of a transformed specimen obtained by the first preferred embodiment of this invention.
Figure 5:
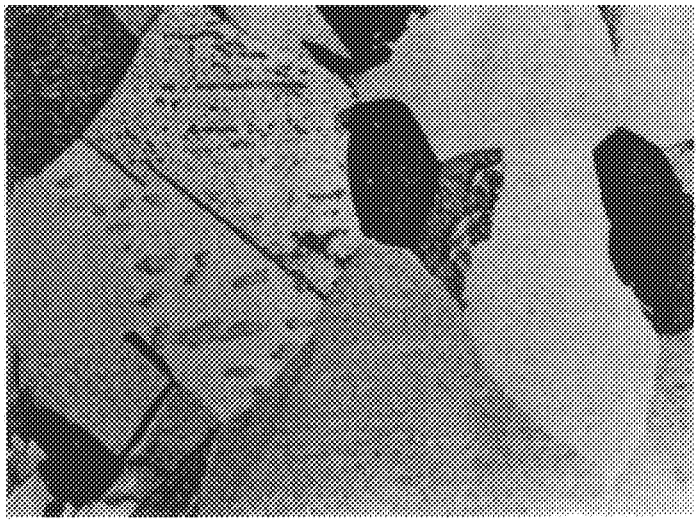
FIG. 5 is a photomicrograph showing the microstructure of a transformed specimen obtained by the first trial method for comparison shown in Table 1.

The alloys with a β+γ dual-phase microstructure described before were subjected to a transformation heat treatment at 1323 K for 12 hours. FIG. 4 shows the microstructure of the specimen representing Example 7 of this invention after the transformation heat treatment. As shown in FIG. 4, the initial size of γ grains, approximately 18 μm, remained unchanged as no coarsening occurred, though the configuration of β phase at grain boundaries became obscure. FIG. 5 shows the microstructure of the specimen representing Trial Alloy for Comparison 9, in which coarsening of γ grains resulted from the application of the transformation heat treatment.

Table 3 shows the results of a tensile test at a temperature of 1473° C. and a strain rate of $5\times10^{-4}s^{-1}$ applied on the specimens after the transformation heat treatment. Table 3 also shows the relationship between the transformation heat treatment conditions and strength.

The specimens in Table 3 were homogenized and thermomechanically heat treated under the same conditions as in Table 1, as shown below.

Homogenizing heat treatment:

Temperature=1323 K

Time=96 hours

Thermomechanical heat treatment:

Temperature=1473 K

Strain rate=$10^{-4}s^{-1}$

Working ratio=60%

Type of working=forging (without casing)

Cooling rate=10 K/min.

TABLE 3-1

| | Chemical Composition | | | | | | | | | | | | | |
|---|---|---|---|---|---|---|---|---|---|---|---|---|---|---|
| | P1 | P2 | P3 | P4 | P5 | P6 | C1 | C2 | C3 | C4 | C5 | C6 | C7 | C8 |
| Element | | | | | | | | | | | | | | |
| Ti | 50.6 | 51.6 | 50.1 | 48.9 | 49.2 | 48.8 | 48.2 | 50.2 | 50.5 | 46.8 | 51.3 | 49.5 | 50.2 | 47.2 |
| Al | 46.5 | 43.5 | 46.6 | 47.0 | 47.0 | 46.8 | 48.6 | 48.6 | 49.5 | 53.2 | 46.3 | 47.0 | 47.0 | 48.2 |
| Cr | 2.90 | 4.90 | 2.80 | 2.83 | 2.85 | 2.60 | | | | | 0.5 | 0.9 | | 1.2 |
| Nb | | | | | 0.99 | 1.05 | | | | | | | | |
| Mo | | | | | | | | | | | | | | 2.2 |
| Hf | | | | | | | | | | | 1.9 | | | |
| Ta | | | | | | | | | | | | 1.6 | | |
| W | | | | | | | | | | | | 1.0 | | |
| V | | | | | | | 3.20 | | | | | | | |
| Mn | | | | | | | | 1.2 | | | | | | |
| Si | | | 0.57 | | | 0.75 | | | | | | | 1.9 | 1.2 |
| B | | | | 1.33 | | | | | | | | | 0.9 | |

TABLE 3-1-continued

| | Chemical Composition | | | | | | | | | | | | | |
|---|---|---|---|---|---|---|---|---|---|---|---|---|---|---|
| | P1 | P2 | P3 | P4 | P5 | P6 | C1 | C2 | C3 | C4 | C5 | C6 | C7 | C8 |
| Transformation Heat Treatment | | | | | | | | | | | | | | |
| Atmosphere/Torr | Vacuum | Vacuum | Vacuum | Vacuum | Vacuum | Vacuum | Vacuum | Vacuum | Vacuum | Vacuum | Vacuum | Vacuum | Vacuum | Vacuum |
| Temperature/K | 1323 | 1323 | 1323 | 1323 | 1323 | 1323 | 1323 | 1323 | 1323 | 1323 | 1323 | 1323 | 1323 | 1323 |
| Time/Hr | 12 | 12 | 12 | 12 | 12 | 12 | 12 | 12 | 12 | 12 | 12 | 12 | 12 | 12 |
| Cooling Rate K/min | 10 | 10 | 10 | 10 | 10 | 10 | 10 | 10 | 10 | 10 | 10 | 10 | 10 | 10 |

P: Preferred Embodiment
C: Trial Alloy for Comparison

TABLE 3-2

| | | Atmosphere | | | Temperature | | | | Time | | | Cooling Rate | | |
|---|---|---|---|---|---|---|---|---|---|---|---|---|---|---|
| | | P1 | C9 | C10 | P1 | P7 | C11 | C12 | P1 | C13 | C14 | P8 | C15 | C16 |
| Element | Ti | 50.6 | 50.6 | 50.6 | 50.6 | 50.6 | 50.6 | 50.6 | 50.6 | 50.6 | 50.6 | 50.6 | 50.6 | 50.6 |
| | Al | 46.5 | 46.5 | 46.5 | 46.5 | 46.5 | 46.5 | 46.5 | 46.5 | 46.5 | 46.5 | 46.5 | 46.5 | 46.5 |
| | Cr | 2.90 | 2.90 | 2.90 | 2.90 | 2.90 | 2.90 | 2.90 | 2.90 | 2.90 | 2.90 | 2.90 | 2.90 | 2.90 |
| | Nb | | | | | | | | | | | | | |
| | Mo | | | | | | | | | | | | | |
| | Hf | | | | | | | | | | | | | |
| | Ta | | | | | | | | | | | | | |
| | W | | | | | | | | | | | | | |
| | V | | | | | | | | | | | | | |
| | Mn | | | | | | | | | | | | | |
| | Si | | | | | | | | | | | | | |
| | B | | | | | | | | | | | | | |
| Transformation Heat Treatment | Atmosphere/Torr | Vacuum | Atmosphere | Argon | Vacuum | Vacuum | Vacuum | Vacuum | Vacuum | Vacuum | Vacuum | Vacuum | Vacuum | Vacuum |
| | Temperature/K | 1323 | 1323 | 1323 | 1323 | 1523 | 1023 | 1123 | 1323 | 1323 | 1323 | 1323 | 1323 | 1323 |
| | Time/Hr | 12 | 12 | 12 | 12 | 12 | 12 | 12 | 12 | 0.5 | 1 | 12 | 12 | 12 |
| | Cooling Rate K/min | 10 | 10 | 10 | 10 | 10 | 10 | 10 | 10 | 10 | 10 | 50 | 1 | 2 |

P: Preferred Embodiment
C: Trial Alloy for Comparison

TABLE 3-3

| | | | Chemical Composition | | | | | | | | | | | | | |
|---|---|---|---|---|---|---|---|---|---|---|---|---|---|---|---|---|
| | | | P1 | P2 | P3 | P4 | P5 | P6 | C1 | C2 | C3 | C4 | C5 | C6 | C7 | C8 |
| Test Results | Strength at 1073K | Before Heat Treatment | 293 | 275 | 322 | 337 | 344 | 350 | 265 | 288 | 320 | 345 | 365 | 388 | 378 | 420 |
| | | After Heat Treatment | 454 | 420 | 446 | 461 | 458 | 422 | 281 | 250 | 285 | 310 | 411 | 432 | 365 | 455 |
| | Strength at 1473K | Before Heat Treatment | 12.1 | 6.8 | 11.0 | 10.3 | 17.1 | 19.3 | 30.3 | 33.6 | 32.4 | 28.8 | 26.7 | 33.8 | 22.8 | 26.9 |
| | | After Heat Treatment | 20.5 | 16.2 | 23.0 | 22.4 | 25.6 | 28.6 | 20.6 | 22.7 | 18.5 | 19.5 | 17.5 | 26.3 | 21.5 | 25.0 |
| | Elongation at 1473K | Before Heat Treatment | >470 | >470 | >470 | >470 | 384 | 421 | 176 | 101 | 116 | 69 | 215 | 128 | 115 | 167 |
| | | After Heat Treatment | 205 | 253 | 193 | 193 | 210 | 238 | 119 | 78 | 70 | 45 | 122 | 53 | 105 | 89 |
| | Beta Phase | Before Heat Treatment | 7 | 18 | 6 | 8 | 13 | 15 | 2 | 1 | 0 | 0 | 4 | 6 | 3 | 4 |
| | | After Heat Treatment | 0 | 0 | 0 | 0 | 2 | 2 | 0 | 0 | 0 | 0 | 0 | 3 | 1 | 1 |
| | Alpha Phase | Before Heat Treatment | 1 | 2 | 1 | 1 | 2 | 2 | 8 | 6 | 13 | 18 | 1 | 1 | 2 | 1 |
| | | After Heat Treatment | 12 | 25 | 8 | 9 | 11 | 13 | 10 | 8 | 15 | 22 | 8 | 4 | 5 | 3 |

P: Preferred Embodiment
C: Trial Alloy for Comparison

TABLE 3-4

| | | | Atmosphere | | | Temperature | | | | Time | | | Cooling Rate | | |
|---|---|---|---|---|---|---|---|---|---|---|---|---|---|---|---|
| | | | P1 | C9 | C10 | P1 | P7 | C11 | C12 | P1 | C13 | C14 | P8 | C15 | C16 |
| Test Results | Strength at 1073K | Before Heat Treatment | 293 | 293 | 293 | 293 | 293 | 293 | 293 | 293 | 293 | 293 | 293 | 293 | 293 |
| | | After Heat Treatment | 454 | 274 | 415 | 454 | 420 | 345 | 362 | 454 | 370 | 387 | 470 | 340 | 374 |
| | Strength at 1473K | Before Heat Treatment | 12.1 | 12.1 | 12.1 | 12.1 | 12.1 | 12.1 | 12.1 | 12.1 | 12.1 | 12.1 | 12.1 | 12.1 | 12.1 |
| | | After Heat Treatment | 20.5 | 13.5 | 21.0 | 20.5 | 24.5 | 12.2 | 12.6 | 20.5 | 13.2 | 12.5 | 23.5 | 15.6 | 16.8 |
| | Elongation at 1473K | Before Heat Treatment | >470 | >470 | >470 | >470 | >470 | >470 | >470 | >470 | >470 | >470 | >470 | >470 | >470 |
| | | After Heat Treatment | 205 | 72.3 | 211 | 205 | 228 | 286 | 255 | 205 | 350 | 338 | 218 | 274 | 240 |
| | Beta Phase volume fraction | Before Heat Treatment | 7 | 7 | 7 | 7 | 7 | 7 | 7 | 7 | 7 | 7 | 7 | 7 | 7 |
| | | After Heat Treatment | 0 | 5 | 2 | 0 | 0 | 6 | 4 | 0 | 6 | 5 | 0 | 4 | 2 |
| | Alpha Phase volume fraction | Before Heat Treatment | 1 | 1 | 1 | 1 | 1 | 1 | 1 | 1 | 1 | 1 | 1 | 1 | 1 |
| | | After Heat Treatment | 12 | 6 | 13 | 12 | 15 | 2 | 3 | 12 | 2 | 3 | 19 | 5 | 7 |

P: Preferred Embodiment
C: Trial Alloy for Comparison

As is obvious from Table 3, the alloys of this invention proved to have high strength and elongation. By comparison, the trial alloys for comparison proved to be unsuitable as structural materials as only either one, not both, of strength and elongation was high. Table 3 shows the changes in the volume fraction of $\alpha_2$ and β phases resulted from the application of the transformation heat treatment, as determined by image analysis processing. In the alloys of this invention, as is obvious from Table 3, β phase disappeared and $\alpha_2$ phase appeared as a result of the transformation heat treatment. In the trial alloys for comparison, in contrast, $\alpha_2$ phase existed independent of the transformation heat treatment, whereas the volume fraction of β phase was very slight. As such, the disappearance of β phase brought about a drop in elongation and an increase in strength in the alloys according to this invention. In the trial alloys for comparison, coarsening of γ grains lowered both elongation and strength.

What is claimed:

1. A process for preparing a TiAl-based intermetallic compound alloy containing chromium and consisting essentially of a dual-phase microscructure of γ phase and 2% to 25% by volume fraction of β phase precipitating at γ grain boundaries, the alloy being prepared as an intermediate product for manufacturing a TiAl-based intermetallic compound alloy consisting essentially of a dual-phase microstructure of α2 and γ phases comprising the steps of:

preparing a molten TiAl-based intermetallic compound alloy consisting essentially of a composition whose atomic fraction is expressed as:

$$Ti_aAl_{100-a-b}Cr_b$$

where $1 \leqq b \leqq 5$ $47.5 \leqq a \leqq 52$ $2a+b \geqq 100$ solidifying the molten alloy;

homogenizing the solidified alloy by heat treatment; and causing the β phase to precipitate at γ grain boundaries by applying thermomechanical heat treatment to the homogenized alloy.

2. A process for preparing a TiAl-based intermetallic compound alloy containing chromium and consisting essentially of a dual-phase microstructure of γ and β phases comprising the steps of:

preparing a molten TiAl-based intermetallic compound alloy consisting essentially of a composition whose atomic fraction is expressed as:

$$Ti_aAl_{100-a\ b-c}Cr_bX_c$$

X:Nb, Mo, Hf, Ta, W, V where $47.5 \leqq a \leqq 52$ $1 \leqq b \leqq 5$ $0.5 \leqq c \leqq 3$ $b \geqq c$ $2a+b+c \geqq 100$ solidifying the molten alloy;

homogenizing the solidified alloy by heat treatment; and causing the β phase to precipitate at γ grain boundaries by applying thermomechanical heat treatment to the homogenized alloy.

3. A process for preparing a TiAl-based intermetallic compound alloy containing chromium and consisting essentially of a dual-phase microstructure of γ and β phases comprising the steps of:

preparing a molten TiAl-based intermetallic compound alloy consisting essentially of a composition whose atomic fraction is expressed as:

$$Ti_aAl_{100-a-b-d}Cr_bY_d$$

Y:Si, B where $47.5 \leqq a \leqq 52$ $1 \leqq b \leqq 5$ $0.1 \leqq d \leqq 2$ $2a+b+d \geqq 100$ solidifying the molten alloy;

homogenizing the solidified alloy by heat treatment; and causing the β phase to precipitate at γ grain boundaries by applying thermomechanical heat treatment to the homogenized alloy.

4. A process for preparing a TiAl-based intermetallic compound alloy containing chromium and consisting essentially of a dual-phase microstructure of γ and β phases comprising the steps of:

preparing a molten TiAl-based intermetallic compound alloy consisting essentially of a composition whose atomic fraction is expressed as:

$$Ti_aAl_{100-a-b-c-d}Cr_bX_cY_d$$

X:Nb, Mo, Hf, Ta, W, V

Y:Si, B where $47.5 \leqq a \leqq 52$ $1 \leqq b \leqq 5$ $0.5 \leqq c \leqq 3$ $b \geqq c$ $0.1 \leqq d \leqq 2$ $2a+b+c+d \geqq 100$ solidifying the molten alloy;

homogenizing the solidified alloy by heat treatment; and causing the β phase to precipitate at γ grain boundaries by applying thermomechanical heat treatment to the homogenized alloy.

5. A process for preparing a TiAl-based intermetallic compound alloy according to one of claims 1, 2, 3, and 4 in which the homogenizing heat treatment comprises holding the solidified alloy in a temperature range of 1273 K to the solidus temperature for 2 to 100 hours and the thermomechanical heat treatment comprises plastically working the homogenized alloy in a non-oxidizing atmosphere at a temperature between 1173 K and the solidus temperature, an initial strain rate of not higher than 0.5 $sec^{-1}$ and a working ratio of not lower than 60% and cooling the plastically worked alloy from the temperature employed in the plastic working to a temperature not lower than 873 K at cooling rate of 10 K/min.

6. A process for preparing a TiAl-based intermetallic compound alloy according to claim 5, in which the non-oxidizing atmosphere is a vacuum of under 0.667 Pa.

7. A process for preparing a TiAl-based intermetallic compound alloy according to claim 5, in which the non-oxidizing atmosphere consists of an atmosphere of inert gas.

8. A process for preparing a TiAl-based intermetallic compound alloy according to claim 5, in which the plastic working comprises isothermal forging.

9. A process for preparing a TiAl-based intermetallic compound alloy according to claim 5, in which the plastic working comprises rolling.

10. A process for preparing a TiAl-based intermetallic compound alloy according to claim 5, in which the plastic working comprises hot extrusion.

11. A process for preparing a TiAl-based intermetallic compound alloy according to claim 5, in which the homogenized alloy is plastically worked in a container of Ti alloy placed in the atmosphere, the container being evacuated to a vacuum of under 0.667 Pa and hermetically sealed by electron-beam welding.

12. A process for preparing a TiAl-based intermetallic compound alloy according to claim 5, in which the homogenized alloy is plastically worked in a sheath of Ti alloy placed in the atmosphere.

* * * * *